United States Patent [19]

Lillibridge

[11] 4,210,977

[45] Jul. 8, 1980

[54] AIR CLEANING APPARATUS

[75] Inventor: Harold R. Lillibridge, San Mateo, Calif.

[73] Assignee: Champion International Corporation, Stamford, Conn.

[21] Appl. No.: 15,787

[22] Filed: Feb. 28, 1979

[51] Int. Cl.[2] ..... B08B 5/02

[52] U.S. Cl. ..... 15/306 R; 15/316 R; 15/405; 118/203

[58] Field of Search ..... 118/104, 203, 301; 15/302, 306 R, 306 A, 316 R, 405, 303, 306 B, 310, 311, 345, 346; 100/174; 101/425

[56] References Cited

U.S. PATENT DOCUMENTS

| | | | |
|---|---|---|---|
| 1,739,647 | 12/1929 | Parks | 118/203 X |
| 1,957,470 | 5/1934 | Milmoe | 118/203 X |
| 2,875,846 | 3/1959 | Yonkers | 15/306 A X |
| 3,004,276 | 10/1961 | Hoffman | 15/306 R |
| 3,765,051 | 10/1973 | Wanat | 15/302 |

FOREIGN PATENT DOCUMENTS

| | | | |
|---|---|---|---|
| 797940 | 7/1958 | United Kingdom | 15/306 R |

*Primary Examiner*—Christopher K. Moore
*Attorney, Agent, or Firm*—Evelyn M. Sommer

[57] ABSTRACT

Apparatus for cleaning an adhesive applicator roll includes a plurality of air jets for directing an air stream against the roll to clean the same. A driven roller assembly rotates the roll as it is being cleaned by the jets.

6 Claims, 4 Drawing Figures

AIR CLEANING APPARATUS

BACKGROUND OF THE INVENTION

1. Field of the Invention:

This invention relates to an apparatus for cleaning sealing material from a roll, and more particularly, to an air cleaning apparatus for removing excess sealing material such as latex or adhesive from an applcation roll used to apply the latex or adhesive to flat or folded sheets, such as envelopes.

2. Description of the Prior Art:

U.S. Pat. No. 3,965,851, assigned to the same assignee as the present invention, discloses an apparatus for applying sealing material, such as latex or adhesive to portions of envelopes, and then drying the material on the envelope for subsequent reuse in sealing the envelope. The apparatus is adapted to convey a single series, or two series of envelopes, in a generally triangular path between a pair of overlapping conveyor belts. At an apex of the triangular shaped path of the overlapped conveyor belts, sealing material such as latex is applied to the inside surface of the flap closure and also the body portion of the envelope.

Sealing material applicator means are provided comprising an impression roller disposed inside the triangular shaped conveying means at a corner thereof, while disposed outside and underneath the conveying means is a glue applicator roller having die portions to which latex material is applied, which die portions successively engage a linear array of envelopes so as to apply the sealing material to the surface of the flap closure and the body of the envelope. The envelopes are then conveyed to a drying station wherein the latex is dryed for subsequent reuse.

It has been found that if the applicator roll is not periodically cleaned to remove excess latex from its surface, the envelopes being successively fed by the applicator roll will tend to adhere to the roll and accordingly create substantial downtime of the apparatus while the roller is either replaced or cleaned, or both.

This invention provides such an apparatus for periodically cleaning the applicator roll to remove excess adhesive accumulated on the roll.

SUMMARY OF THE INVENTION

In accordance with the present invention, an air guide is mounted on a bracket adjacent the adhesive applicator roll. The air guide is hollow and generally has a concave upper surface having a radius approximating the radius of the convex surface of the applicator roll. Nozzles for supplying air from a source are connected to the interior of the hollow air guide. The air guide includes a pair of elongated air channels communicating with the nozzles and extending substantially perpendicular to a plurality of spaced air jet orifices on the upper concave surface of the guide. Air is continuously supplied to the interior of the air guide through the nozzles and dispensed through the jet orifices onto the applicator roll to remove excess adhesive accumulated thereon.

A roller is provided intermediate the ends of the air guide structure which extends slightly above the concave upper surface of the air guide structure. The roller is mounted on a driven shaft and contacts the application roll, whereby the roll may be rotated relative to the stationary air guide so that all portions of the roll may be cleaned. The present invention eliminates the need for complicated tripping mechanisms or water boxes employed in connection with prior art adhesive applicator rolls.

BRIEF DESCRIPTION OF THE DRAWING

Further objects and advantages of the invention will become apparent from the following specification and claims, and from the accompanying drawing, wherein:

DETAILED DESCRIPTION OF THE PREFERRED EMBODIMENT

Figure 1:
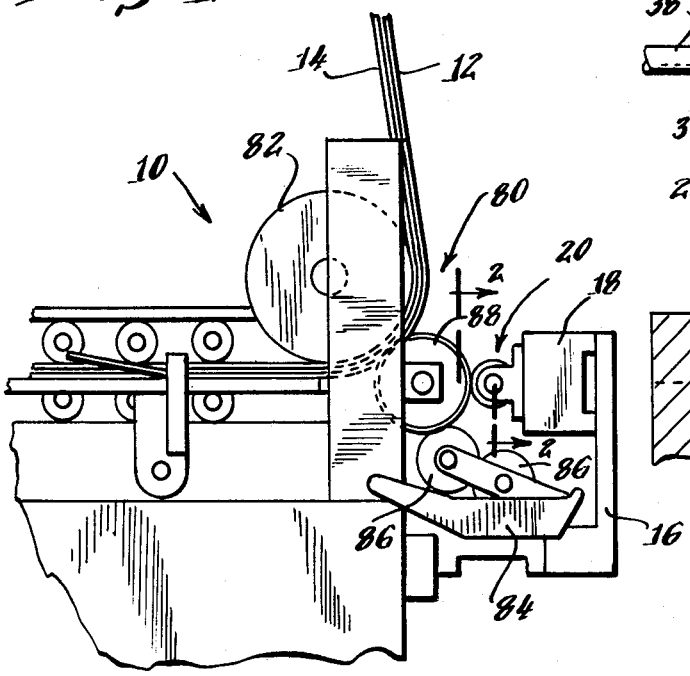
FIG. 1 is a side view in elevation of a portion of an apparatus for applying sealing material to envelopes utilizing the air cleaning apparatus of the present invention.

Referring now to the drawing in detail, wherein like numerals indicate like elements throughout the several view, and in particular to FIG. 1, a portion of an apparatus 10 for applying sealing material to envelopes is illustrated.

Generally, envelopes are transported successively between a pair of overlapped conveyor belts 12 and 14 in a triangular path past a plurality of work stations. The envelopes are fed between the belts at one end of the apparatus wherein the belts are not overlapped.

Disposed at the lower right hand portions of the path of the conveyors 12 and 14 is a sealing material applicator means 80. The sealing material applicator means 80 is described in detail in U.S. Pat. No. 3,965,851, which disclosure is incorporated herein by reference. For purposes of the present invention, it should be understood that the applicator means 80 includes a gum impression roller 82 disposed against the inner conveyor belt 14, while disposed under the outer conveyor belt 12 is an arrangement of a gum box 84, a series of glue transfer rollers 86, and a sealing material applicator roller 88.

As the envelopes are carried by the belts 12 and 14 between the nip of impression roller 82 and applicator roll 88, special dies or stencils on the applicator roll apply glue or adhesive in a pattern to the flap and body of the envelopes. The sealing material applicator roll 88, as disclosed in U.S. Pat. No. 3,965,851 is provided with both a right and left hand section, each section having separate dies or stencils enabling a dual series of envelopes to be simultaneously processed. Impression roller 82 serves as a backing roller for the application roll 88, while glue transfer rollers 86 in communication with the glue within pot 84 supply glue to the surface of the application roller.

Figure 4:
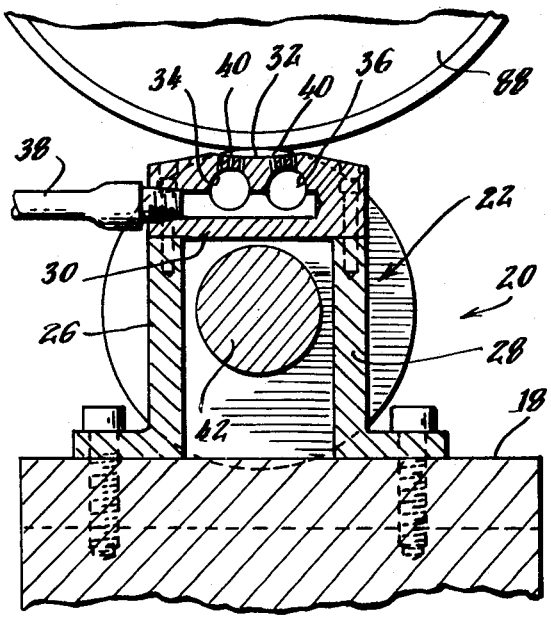
FIG. 4 is a cross-sectional view taken substantially along the plane indicated by line 4—4 of FIG. 3
Figure 2:
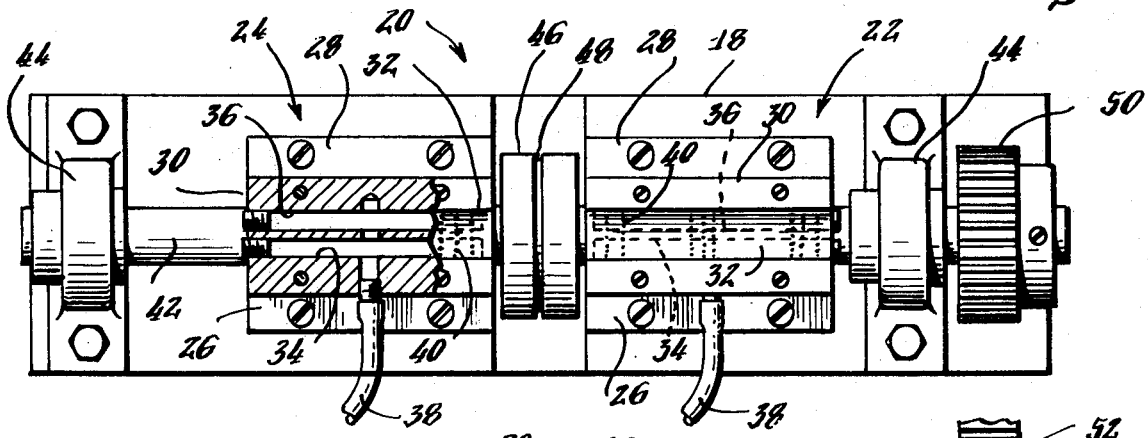
FIG. 2 is a cross-sectional view taken substantially along the plane indicated by line 2—2 of FIG. 1 and illustrates the air cleaning apparatus of the present invention.
Figure 3:
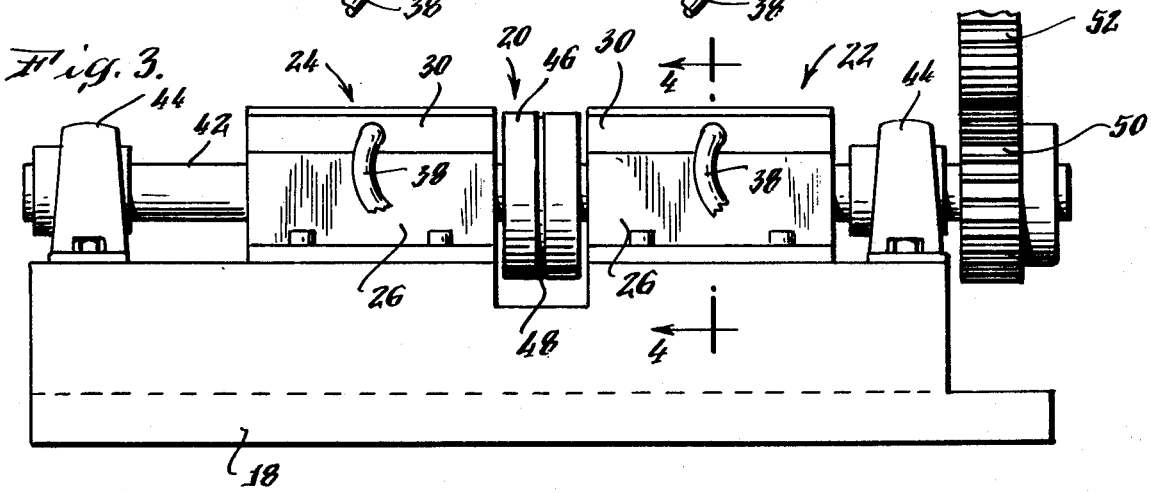
FIG. 3 is a front view in elevation of the air cleaning apparatus of the present invention illustrated in FIG. 2.

If the surface of roll 88 is not periodically cleaned, congealed adhesive will tend to spread to other portions of the roller and contact the envelopes causing them to adhere to each other or to the roll. Accordingly, a suitable mounting bracket 16 is connected to the frame work of the apparatus 10 adjacent glue pot 84. Bracket 16 mounts a support block 18 of an air cleaning apparatus 20 illustrated in greater detail in FIGS. 2 to 4, inclusive.

Air cleaning apparatus 20 includes a right and left-handed air guide structure 22 and 24, respectively. When used in conjunction with the apparatus disclosed in U.S. Pat. No. 3,965,851, the width of the right and left hand air guide structures 22, 24 respectively corresponds to the width of the associated right and left hand sections of the applicator roll 88. Each of the air guide structures includes space L-spaced support beams 26 and 28 having a horizontally extending air guide 30 seated thereon and fixed thereto by suitable fasteners such as bolts or the like.

Each air guide 30 includes an upper concave surface 32 which approximates the contour of the convex surface of the applicator roll 88. A pair of elongated channels 34 and 36 extend along the horizontal length of the air guide and are in communication with an air supply nozzle 38. Extending perpendicular to the channels 34 and 36 are a plurality of air jet orfices 40 at spaced locations along each of the channels.

In use, air is supplied under pressure through nozzles 38 to both the right and left-hand air guides 30. Air will flow through the channels 34 and 36 in each guide and out the jet orifices 40 adjacent to and against the outer convex surface of the applicator roll 88 to blow and thereby clean congealed adhesive from the surface of the roll 88.

In order to clean all portions of the applicator roll 88, it is required to rotate the roll while supplying the air under pressure through the jet orifices 40. Accordingly, a shaft 42 extends between the L-shaped beams 26 and 28 of each of the right-hand and left-hand air guides 22 and 24, respectively, and is journaled in bearings 44 mounted on support block 18. A roller 46 is fixed to the center portion of shaft 42. Roller 46 has an annular groove 48 cut therein and extends between the right and left-hand air guides 22 and 24 slightly above the concave surfaces 32 into rolling engagement with the convex outer suface of the applicator roll 88.

Mounted on one end of shaft 42 is a pinion 50 which is driven by a suitable gear train 52 to rotate shaft 42 and roller 46. Rotation of the shaft 42 and roller 46 will cause the applicator roll 88 to rotate as air is supplied through the jet orifices to clean the application roller.

What is claimed as new is:

1. Air cleaning apparatus for removing adhesive from a rotatably mounted applicator roll of an adhesive applicating device comprising:

rotatable roller means, mounted in contacting relation with said applicator roll, said roller means for imparting a rotation to said applicator roll;

air guide means mounted adjacent said applicator roll, said air guide means including air jet means on opposite sides of said roller means for issuing an air stream against the surface of said applicator roll to clean the same as it is rotated by said roller means.

2. Air cleaning apparatus in accordance with claim 1 wherein said roller means includes an elongated shaft, at least one roller on said shaft, and drive means connected to one end of said shaft for rotating the same.

3. Air cleaning apparatus in accordance with claim 2 further including:

a pair of parallel, L-shaped mounts, for supporting said air guide means with said shaft of said roller means extending therebetween.

4. Air cleaning apparatus in accordance with claim 1 wherein said air jet means includes a plurality of air channels extending along the length of said air guide means, and a plurality of air jet orifices extending perpendicular to said air channels at spaced locations therealong and in communication with said air channels.

5. Air cleaning apparatus in accordance with claim 1 wherein said air guide means further includes an upper concave surface.

6. Air cleaning apparatus in accordance with claim 5 wherein said roller means extends slightly above the concave surface of said air guide means.

* * * * *